US006434813B1

(12) United States Patent
Grabmeier

(10) Patent No.: US 6,434,813 B1
(45) Date of Patent: Aug. 20, 2002

(54) ROOF CURB INSTALLATION TOOL

(75) Inventor: Richard James Grabmeier, Shawnee, KS (US)

(73) Assignee: Butler Manufacturing Company, Kansas City, MO (US)

( * ) Notice: Subject to any disclaimer, the term of this patent is extended or adjusted under 35 U.S.C. 154(b) by 0 days.

(21) Appl. No.: 09/835,568

(22) Filed: Apr. 17, 2001

(51) Int. Cl.[7] ..... B23Q 7/00

(52) U.S. Cl. ..... 29/559; 52/749.12; 52/DIG. 1; 29/281.15; 269/46

(58) Field of Search ..... 29/281.5, 559; 269/46; 294/15, 16; 52/518.1, 200, 749.12, 745.15, DIG. 1

(56) References Cited

U.S. PATENT DOCUMENTS 4,413,450 A * 11/1983 Brower
4,559,753 A * 12/1985 Brueske
5,190,329 A * 3/1993 Steer et al. ..... 294/15

* cited by examiner

*Primary Examiner*—David P. Bryant
*Assistant Examiner*—Steven A Blount
(74) *Attorney, Agent, or Firm*—Shoemaker and Mattare

(57) ABSTRACT

A roof curb installation tool has a pair of sliding hinged hooks for lifting the edge of a metal roof panel, and a pair of clamping tangs which can be secured to a vertical roof seam while a curb is being installed at a hole in the roof.

6 Claims, 4 Drawing Sheets

ROOF CURB INSTALLATION TOOL

BACKGROUND OF THE INVENTION

This invention relates to a roof curb installation tool. A curb is a structural reinforcement and a water barrier which is installed around an opening which has been made in a roof, when installing skylights, smoke and heat vents, support for mechanical equipment, and the like. Curbs are usually prefabricated, but because the necessary roof opening is almost always cut in the field, the essential reinforcing plates and diverters are difficult to place, especially in larger openings. Butler Manufacturing Company's U.S. Pat. No. 4,559,753 discloses a method of installing curbs in openings in its metal roofs. These roofs comprise metal roof which are joined in place edgewise by forming standing seams which protrude upward well above the central portions of the panels.

Installation of curbs around a hole cut in an existing roof is difficult labor. Normally, a worker must lift the cut edge of the sheet metal by hand in order to install, for example, a diverter plate beneath an existing panel. It would be better to have a tool for lifting and holding the edge of the metal panel.

SUMMARY OF THE INVENTION

An object of the invention is to facilitate the placement of internally flanged curbs on metal roofs.

A related object is to provide workers with a tool with which they can lift up and hold the edge of a metal panel while installing a curb on a seamed roof.

These and other objects are attained by a roof curb installation tool as described below.

BRIEF DESCRIPTION OF THE DRAWINGS

In the accompanying drawings,

FIGS. 4–7 show, in simplified form, a sequence of steps in which the

DESCRIPTION OF THE PREFERRED EMBODIMENT

Figure 1:
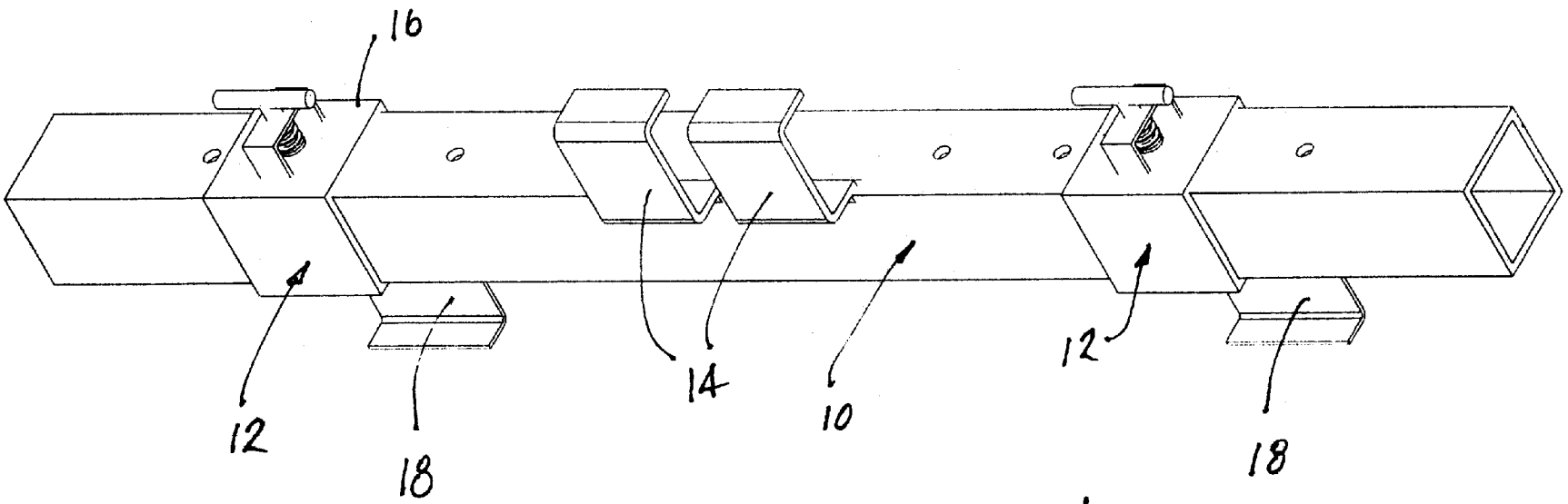
FIG. 1 is an isometric view of a roof curb installation tool embodying the invention.
Figure 2:
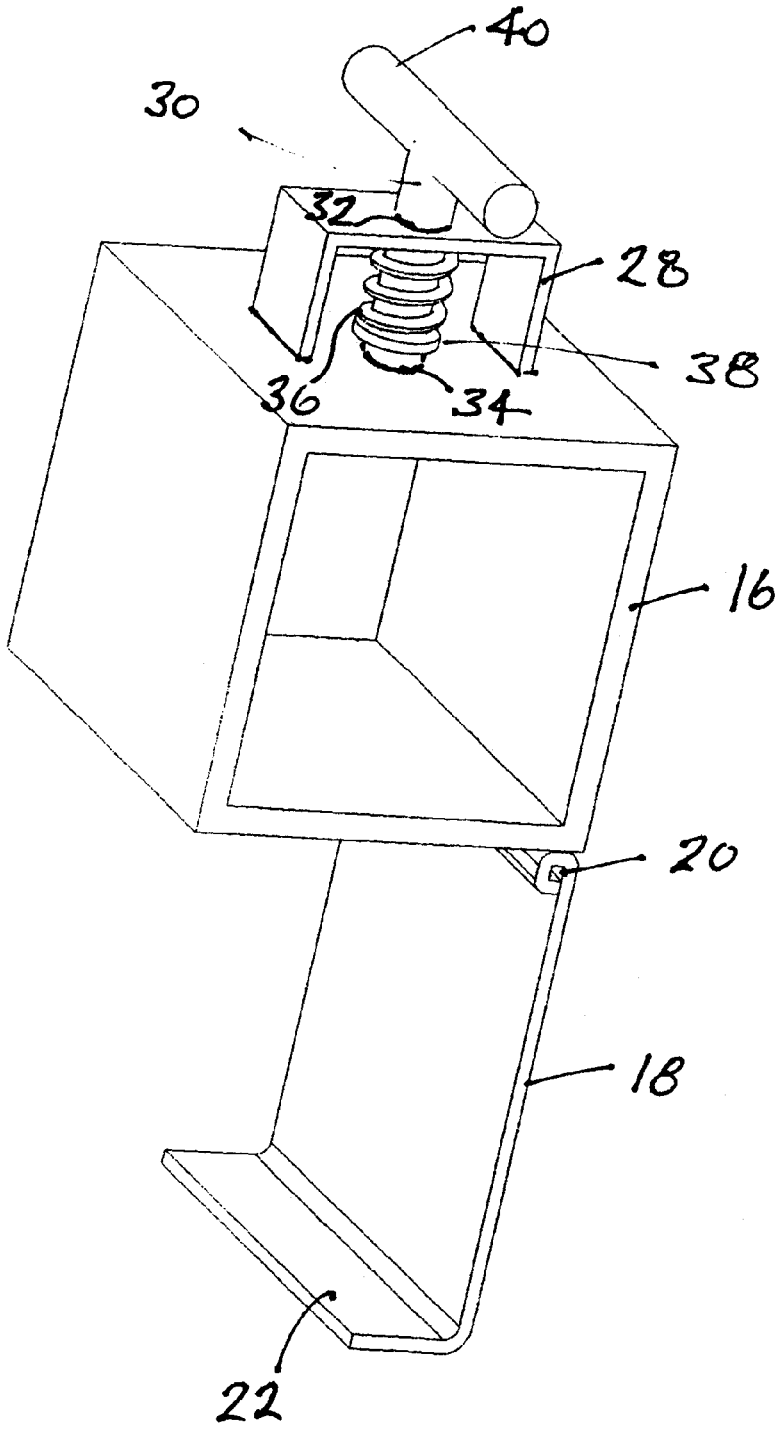
FIG. 2 is a detail of a hook carrier shown in FIG. 1.

A roof curb installation tool embodying the invention includes a bar 10 of metal tube stock having two or more adjustable sliding carrier assemblies 12 thereon. The bar has a rectangular (preferably square) cross section, and thus has four longitudinal edges. A four-foot length of two-inch square stock is presently contemplated, but the best dimensions may vary with the application. Longer lengths could be built up from two or more bars having a telescoping fit or complementary ends shaped as pins and sockets.

Two roof seam clamping 14 tangs are welded to one face of the bar, midway between its ends, and extend perpendicularly away from the face at one of the edges.

Each adjustable carrier assembly includes a body 16 having a sliding fit on the bar 10, and a hook 18 attached thereto by means of a hinge 20. The carrier is oriented with respect to the bar so that the hinges and the clamping tangs are diagonally opposite one another, when viewed along the length of the bar.

The ends 22 of the hooks are flat, so that they can be inserted into a narrow gap beneath a roof panel, and are bent at about a ninety degree angle approximately 2¾" from the hinge points, allowing the hook ends to extend just below the flats of fully seamed MR-24 panels when the tool body is laid across the seams and rotated so that the hinge points are at the lowest point on the tube.

The fact that the bodies can slide on the bar allows the hooks to be placed at various intervals along the length of the bar. A series of holes 26 are drilled through at least one wall of the bar, and the carrier assembly 12 has a latch mechanism which releasably engages any of the holes. The latch mechanism includes a U-shaped bracket 28 whose arms are welded to the body, an a T-shaped pin 30 which extends through a hole 32 in the bracket and an aligned hole 34 in the body. A compression spring 36 is disposed on the pin, between the bottom surface of the bracket, and a shoulder 38 on the pin. The spring urges the pin toward the bar, so it snaps into a hole 26 in the bar when that hole is aligned with holes 32 and 34. One releases the pin from the bar by pulling up on the handle 40.

The seam clamping tangs referred to above are short U-channel-shaped metal pieces attached near the center of the tube and spaced just far enough apart to straddle the machine-formed portion of the MR-24 and VRS panel seams.

Figure 3:
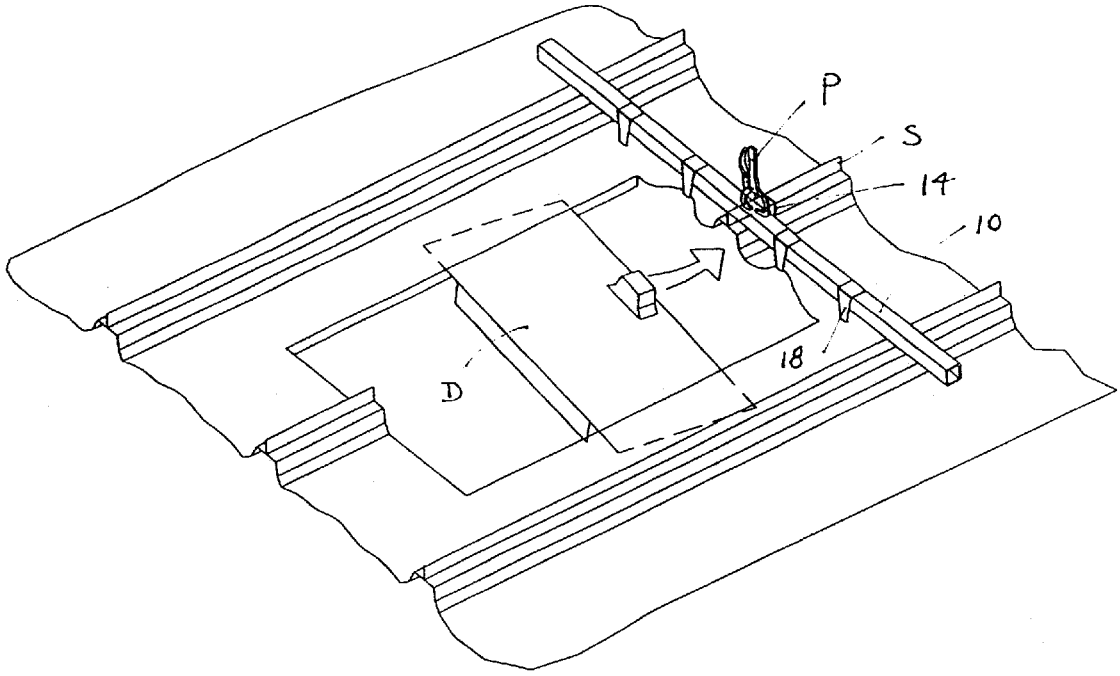
FIG. 3 is a perspective view of the tool as it is first applied a curb installation job.
Figure 4:
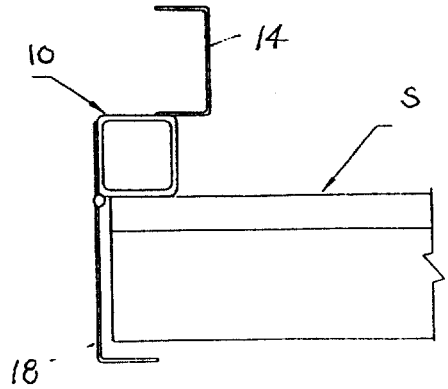
Figure 5:
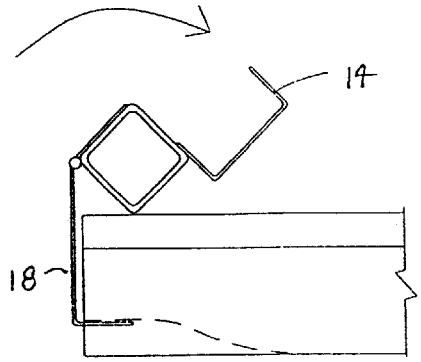
Figure 6:
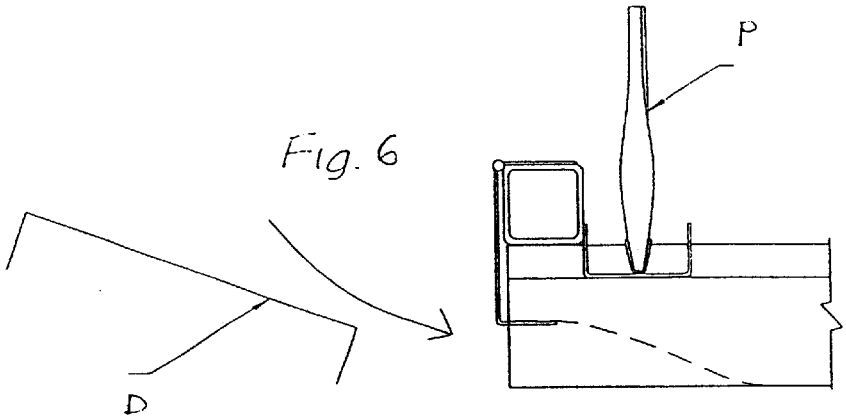
Figure 7:
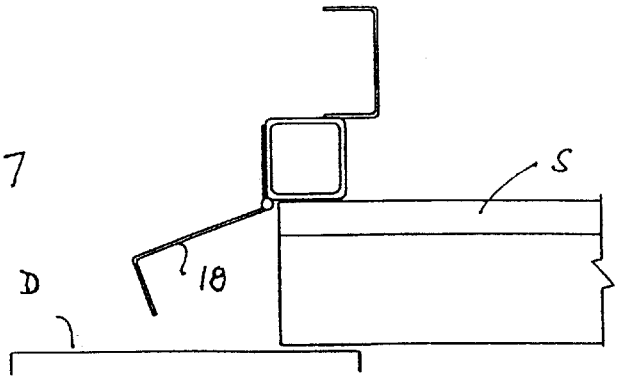

The tool is particularly useful for lifting the flat portion of the up-slope roof panels above the plane of the roof, so that a worker to can slide an internally flanged curb diverter plate "D" beneath a roof panel, as suggested in FIG. 3. The process, illustrated in FIGS. 4–7, is described below.

After a hole has been cut in the roof, the curb installation tool is placed across the roof panel seams just over the upslope edge of the hole. The tool is oriented with the hooks 18 facing the down slope direction and the clamping tangs 14 facing perpendicularly up from the roof plane. The bar is placed with the clamping tangs above a roof panel seam, one on either side of the seam.

The hooks 18 are allowed to hang downward from the tool body, with their ends extending underneath the edges of the roof panels. The carrier assemblies 12 are then moved along the tool body, if necessary, to desired lifting spots on the panel edges.

With the hooks now engaged under the roof panels (FIG. 4), the bar is rolled (FIG. 5) in an upslope direction one-quarter turn. This rotation draws the hooks upward, and the hooks lift the flat portions of the panels as a consequence. The clamping tangs pass downward, as the bar is turned, on either side of the roof seam "S" over which they have been centered, and come to rest (FIG. 6) against the tops of the metal panels. Now a locking pliers "P" (FIGS. 3 and 6) is attached tightly to the roof panel seam, holding the clamping tangs down against the panels, thus keeping the tool body from rotating back to its initial position. The tool is left in the rotated position until the diverter plate has been properly positioned under the roof panels.

After the diverter plate has been inserted under the roof panel edge, the locking pliers may be removed from the panel seam and the curb installation tool is allowed to rotate back to its original position. The hooks are then slid out from between the roof panels and the diverter plate, and the curb installation tool is removed.

Since the invention is subject to modifications and variations, it is intended that the foregoing description and the accompanying drawings shall be interpreted as only illustrative of the invention defined by the following claims.

I claim:

1. A roof curb installation tool for lifting and holding an edge of a metal panel running transverse to a standing seam previously formed between that panel and an adjacent panel, said tool comprising an elongate bar, at least two carriers, each having a body adapted for sliding along said bar, each body having a hinge and a hook connected to the body by said hinge, and a pair of clamping tangs welded to said bar adjacent one another, with a space between them just sufficient to receive the standing seam.

2. The tool of claim 1, wherein the bar has a series of holes, and each carrier has a spring-loaded pin adapted to engage in any of said holes, whereby the location of the carrier on the bar may be changed.

3. The tool of claim 1, wherein the bar has a rectangular cross-section and thus four longitudinal edges, and the clamping tangs extend upward from one of said edges, and each carrier body has a rectangular cross-section with the hinge mounted at one of the longitudinal edges of the body, said body being installed on said bar so that said hinge and said tangs are diagonally opposite to one another.

4. The tool of claim 1, wherein said clamping tangs are disposed on the bar substantially midway between its ends, and at least one of said carriers is installed on either side of said tangs.

5. The tool of claim 1, wherein each of said hooks has a flattened tip so that it can be inserted into a narrow gap beneath a roof panel.

6. A method of lifting and holding an edge of a metal roof panel running transverse to a standing seam previously formed between that panel and an adjacent panel, said method comprising steps of providing a tool having an elongate bar, a pair of carriers each having a body adapted for sliding along said bar and a hook hinged to the body, and a pair of clamping tangs welded to said bar adjacent one another, with a space between them just sufficient to receive the standing seam, placing the tool transversely across the seam, and parallel to and above said edge, with said clamping tangs disposed vertically above and astride the seam, engaging said hooks beneath said edge, rotating the bar so as to draw the hooks upward and force the clamping tangs downward against the roof panels, and applying a clamp to the seam above the clamping tangs to secure the bar in its rotated position.

* * * * *